US009591888B2

(12) United States Patent
Linth et al.

(10) Patent No.: US 9,591,888 B2
(45) Date of Patent: Mar. 14, 2017

(54) FOOTWEAR ASSEMBLIES HAVING DIAGONALLY OPPOSING REINFORCED INSOLE PORTIONS AND ASSOCIATED METHODS

(71) Applicant: Danner, Inc., Portland, OR (US)

(72) Inventors: Andrew James Linth, Portland, OR (US); Aaron Barker, Portland, OR (US)

(73) Assignee: LaCrosse Footwear, Inc., Portland, OR (US)

( * ) Notice: Subject to any disclaimer, the term of this patent is extended or adjusted under 35 U.S.C. 154(b) by 821 days.

(21) Appl. No.: 13/684,035

(22) Filed: Nov. 21, 2012

(65) Prior Publication Data

US 2013/0133225 A1 May 30, 2013

Related U.S. Application Data

(60) Provisional application No. 61/564,700, filed on Nov. 29, 2011.

(51) Int. Cl.
*A43B 7/28* (2006.01)
*A43B 9/02* (2006.01)
(Continued)

(52) U.S. Cl.
CPC ..... *A43B 7/28* (2013.01); *A43B 7/144* (2013.01); *A43B 7/148* (2013.01); *A43B 7/1445* (2013.01);
(Continued)

(58) Field of Classification Search
CPC ..... A43B 9/00; A43B 13/38; A43B 13/383; A43B 13/127; A32B 9/02
(Continued)

(56) References Cited

U.S. PATENT DOCUMENTS 2,538,170 A 1/1951 Stritter
5,729,918 A * 3/1998 Smets ..... 36/91
(Continued)

FOREIGN PATENT DOCUMENTS

WO WO-2013081947 6/2013

OTHER PUBLICATIONS

International Search Report and Written Opinion: International Patent Application No. PCT/US2012/066415: Applicant: Danner, Inc.: Feb. 12, 2013; 7 pages.

*Primary Examiner* — Sharon M Prange
(74) *Attorney, Agent, or Firm* — Perkins Coie LLP

(57) ABSTRACT

A footwear assembly has a sole assembly with an insole board having a peripheral edge, a heel portion, a forefoot portion, and an arch portion. The insole board has a lateral side, a medial side, a top surface, and a bottom surface facing away from the top surface. The footwear assembly has an upper with a lower side portion having a lateral forefoot flange, a lateral arch flange, a lateral heel flange, a medial forefoot flange, a medial arch flange, and a medial heel flange. The lateral forefoot flange is stitched to the top surface of the insole board along the forefoot portion, and the lateral arch flange and the lateral heel flange wrap around the peripheral edge along the insole board's lateral side and are attached to the bottom surface at the arch portion and heel portion without being stitched to the insole board's top surface. The medial heel flange is stitched to the top surface of the insole board along the heel portion portion, and the medial arch flange and the medial forefoot flange are wrapped around peripheral edge along the insole board's lateral side and are attached to the bottom surface at the arch portion and forefoot portion without being stitched to the insole board's top surface.

28 Claims, 10 Drawing Sheets

(51) Int. Cl.

| | |
|---|---|
| ***A43B 9/10*** | (2006.01) |
| ***A43B 13/38*** | (2006.01) |
| ***A43B 7/14*** | (2006.01) |
| ***A43B 13/12*** | (2006.01) |
| ***A43B 13/14*** | (2006.01) |

(52) U.S. Cl.
CPC ..... *A43B 9/02* (2013.01); *A43B 9/10* (2013.01); *A43B 13/127* (2013.01); *A43B 13/141* (2013.01); *A43B 13/38* (2013.01); *A43B 13/383* (2013.01)

(58) Field of Classification Search
USPC ..... 36/19 A, 19 R, 19.5, 21, 25 R, 30 R
See application file for complete search history.

(56) References Cited

U.S. PATENT DOCUMENTS

| | | | | |
|---|---|---|---|---|
| 5,933,896 | A * | 8/1999 | Gallina | 12/142 P |
| 6,484,420 | B1 * | 11/2002 | Chi et al. | 36/12 |
| 6,763,610 | B2 * | 7/2004 | Issler | 36/17 A |
| 6,928,755 | B2 * | 8/2005 | Chen et al. | 36/12 |
| 7,543,398 | B2 * | 6/2009 | Hsaio et al. | 36/55 |
| 7,793,427 | B2 * | 9/2010 | Sessa et al. | 36/17 R |
| 8,789,292 | B2 * | 7/2014 | Ludemann et al. | 36/12 |
| 2006/0191163 | A1 | 8/2006 | Nakano | |
| 2009/0113756 | A1 | 5/2009 | Chang | |
| 2010/0126039 | A1 | 5/2010 | McClaskie et al. | |

* cited by examiner

FOOTWEAR ASSEMBLIES HAVING DIAGONALLY OPPOSING REINFORCED INSOLE PORTIONS AND ASSOCIATED METHODS

CROSS REFERENCE TO RELATED APPLICATION

This application claims priority to and the benefit of U.S. Provisional Patent Application No. 61/564,700, titled Footwear Assemblies Having Diagonally Opposing Reinforced Insole Portions and Associated Methods, filed Nov. 29, 2011, which is incorporated herein in its entirety by reference thereto.

TECHNICAL FIELD

The present disclosure is directed generally to footwear assemblies having insole boards securely stitched and adhered to corresponding uppers and/or midsoles and/or outsoles.

BACKGROUND

Articles of footwear have been designed for in a wide variety of physical activities including walking, running, hiking, trekking, hunting, backpacking, and indoor and outdoor activities. For example, hiking and work boots are typically designed to provide a wearer with suitable comfort and support for hiking or walking on uneven or rough terrain. Conventional hiking or work boots, however, can be relatively heavy. Every time a wearer takes a step, such as while walking or hiking, the wearer must lift the weight of the boot. After hundreds or thousands of steps, that additional weight can be fatiguing on the wearer's legs. Accordingly, it is highly desirable to minimize the weight of the footwear without overly compromising the stability and support of the footwear.

The footwear, such as a boot, is often designed in view of a typical wearer's gait cycle. The typical gate cycle includes several phases, including heel strike, flat foot, heel off, and toe off. During heel strike the boot initially strikes the ground at approximately the rear, medial portion of the boot's heel area. As the gait cycle progresses from heel strike toward flat foot, the loads are applied along the medial side of the heel portion. Progressing from flat foot through heel off and toe off, the loads typically move forwardly to the forefoot area of the boot and diagonally from the medial side to the lateral side of the boot. Accordingly, during heel off and toe off, the primary loads are at the lateral side of the forefoot until the wearer pushes off with his/her toes. A properly designed boot or other footwear can facilitate the wearer's gait cycle while providing stability and support to the wearer's foot and leg.

U.S. Pat. Nos. 6,484,420 and 6,757,990 and U.S. patent application Ser. No. 12/110,739 (filed May 18, 2011) disclose a significant advancement in footwear technology to achieve a lightweight footwear assembly while maintaining a very stable platform. U.S. Pat. Nos. 6,484,420 and 6,757,990 and U.S. patent application Ser. No. 12/110,739 are incorporated herein in their entirety by reference. The footwear disclosed by U.S. Pat. Nos. 6,484,420 and 6,757,990 incorporates a construction wherein at least a portion of the lateral and medial peripheral flanges of the upper are stitched to the insole board in the phalangeal and heel portions but not through the arch portion. Additionally, the lateral and medial peripheral flanges of the upper are wrapped around the lateral peripheral edge of the insole board in the arch portion and the medial peripheral flange of the upper is wrapped around the medial peripheral edge of the insole board in the arch portion. Moreover, the lateral and medial peripheral flanges are adhesively secured to the bottom surface of the arch portion of the insole board. This construction provides a very lightweight and stable platform, although there are areas where improvements may be made for selected footwear.

SUMMARY

Footwear assemblies and associated manufacturing methods in accordance with the present disclosure provide footwear assemblies with diagonally opposing reinforced insole portions that overcome drawbacks of the prior art and that provide other benefits. In at least one embodiment, a footwear assembly has a sole assembly connected to an upper. The sole assembly has an outsole, a midsole connected to the outsole, and an insole board attached to the midsole. The insole board has a heel portion, a forefoot portion, and an arch portion between the heel and forefoot portions. The insole board has lateral and medial sides, a top surface facing away from the midsole, and a bottom surface facing toward the midsole. The upper has a lower side portion with a lateral side portion, a medial side portion, and a rear side portion extending between the lateral and medial side portions adjacent to the heel portion of the insole board. The lower side portion has a toe side portion extending between the lateral and medial side portions adjacent to the forefoot portion of the insole board. The lateral side portion has a lateral forefoot flange, a lateral arch flange, and a lateral heel flange. The medial side portion has a medial forefoot flange, a medial arch flange, and a medial heel flange. The lateral forefoot flange flares outwardly and is stitched to the top surface of the insole board along the forefoot portion. The lateral arch flange and the lateral heel flange are wrapped around the lateral side of the insole board and are attached to the bottom surface at the arch portion and heel portion without being directly secured to the top surface of the insole board. The medial heel flange flares outwardly and is stitched to the top surface of the insole board along the heel portion portion. The medial arch flange and the medial forefoot flange are wrapped around the lateral side of the insole board and are attached to the bottom surface at the arch portion and forefoot portion without being directly secured to the top surface of the insole board.

In another embodiment, a footwear assembly has a sole assembly with an insole board having a peripheral edge, a heel portion, a forefoot portion, and an arch portion. The insole board has a lateral side, a medial side, a top surface, and a bottom surface facing away from the top surface. The footwear assembly has an upper with a lower side portion having a lateral forefoot flange, a lateral arch flange, a lateral heel flange, a medial forefoot flange, a medial arch flange, and a medial heel flange. The lateral forefoot flange is stitched to the top surface of the insole board along the forefoot portion, and the lateral arch flange and the lateral heel flange wrap around the peripheral edge along the insole board's lateral side and are attached to the bottom surface at the arch portion and heel portion without being stitched to the insole board's top surface. The medial heel flange is stitched to the top surface of the insole board along the heel portion portion, and the medial arch flange and the medial forefoot flange are wrapped around peripheral edge along the insole board's lateral side and are attached to the bottom surface at the arch portion and forefoot portion without being stitched to the insole board's top surface.

Another embodiment provides a method of making a footwear assembly that comprises positioning an insole board adjacent to a lower side portion of an upper. The insole board has a peripheral edge, a heel portion, a forefoot portion, an arch portion, a lateral side, a medial side, a top surface, and a bottom surface facing away from the top surface. The upper has a lower side portion with a lateral forefoot flange, a lateral arch flange, a lateral heel flange, a medial forefoot flange, a medial arch flange, and a medial heel flange. The method includes stitching the lateral forefoot flange to the top surface of the insole board along the forefoot portion, and wrapping the lateral arch flange and the lateral heel flange wrap around the peripheral edge along the insole board's lateral side, wherein the lateral arch flange and the lateral heel flange are out of direct engagement with the insole board's top surface. The method includes attaching the lateral arch flange and the lateral heel flange to the bottom surface at the arch portion and heel portion without the lateral arch flange and the lateral heel flange being stitched to the insole board's top surface. The medial heel flange is stitched to the top surface of the insole board along the heel portion portion, and the medial arch flange and the medial forefoot flange are wrapped around the peripheral edge along the insole board's lateral side, with the medial arch flange and the medial forefoot flange being out of direct engagement with the insole board's top surface. The method includes attaching the medial arch flange and the medial forefoot flange to the bottom surface at the arch portion and forefoot portion without being stitched to the insole board's top surface.

DETAILED DESCRIPTION

Footwear assemblies with uppers securely attached to insole boards via adhesive and asymmetrically disposed stitching, and associated methods for using and making such assemblies, are described in detail herein in accordance with embodiments of the present disclosure. The footwear assemblies overcome drawbacks experienced in the prior art and provide other benefits. Certain details are set forth in the following description and in FIGS. 1-10 to provide a thorough and enabling description of various embodiments of the disclosure. Other details describing well-known structures and components often associated with footwear assemblies and methods of forming such assemblies, however, are not set forth below to avoid unnecessarily obscuring the description of various embodiments of the disclosure. Many of the details, dimensions, angles, relative sizes of components, and/or other features shown in the Figures are merely illustrative of particular embodiments of the disclosure. Accordingly, other embodiments can have other details, dimensions, angles, sizes, and/or features without departing from the spirit and scope of the present disclosure. In addition, further embodiments of the disclosure may be practiced without several of the details described below, while still other embodiments of the disclosure may be practiced with additional details and/or features. In the Figures, identical reference numbers identify identical, or at least generally similar, elements. Moreover, one of ordinary skill in the art will appreciate that any relative positional terms such as above, below, over, under, etc. do not necessarily require a specific orientation of the footwear assemblies as described herein. Rather, these or similar terms are intended to describe the relative position of various features of the disclosure described herein.

Figure 1:
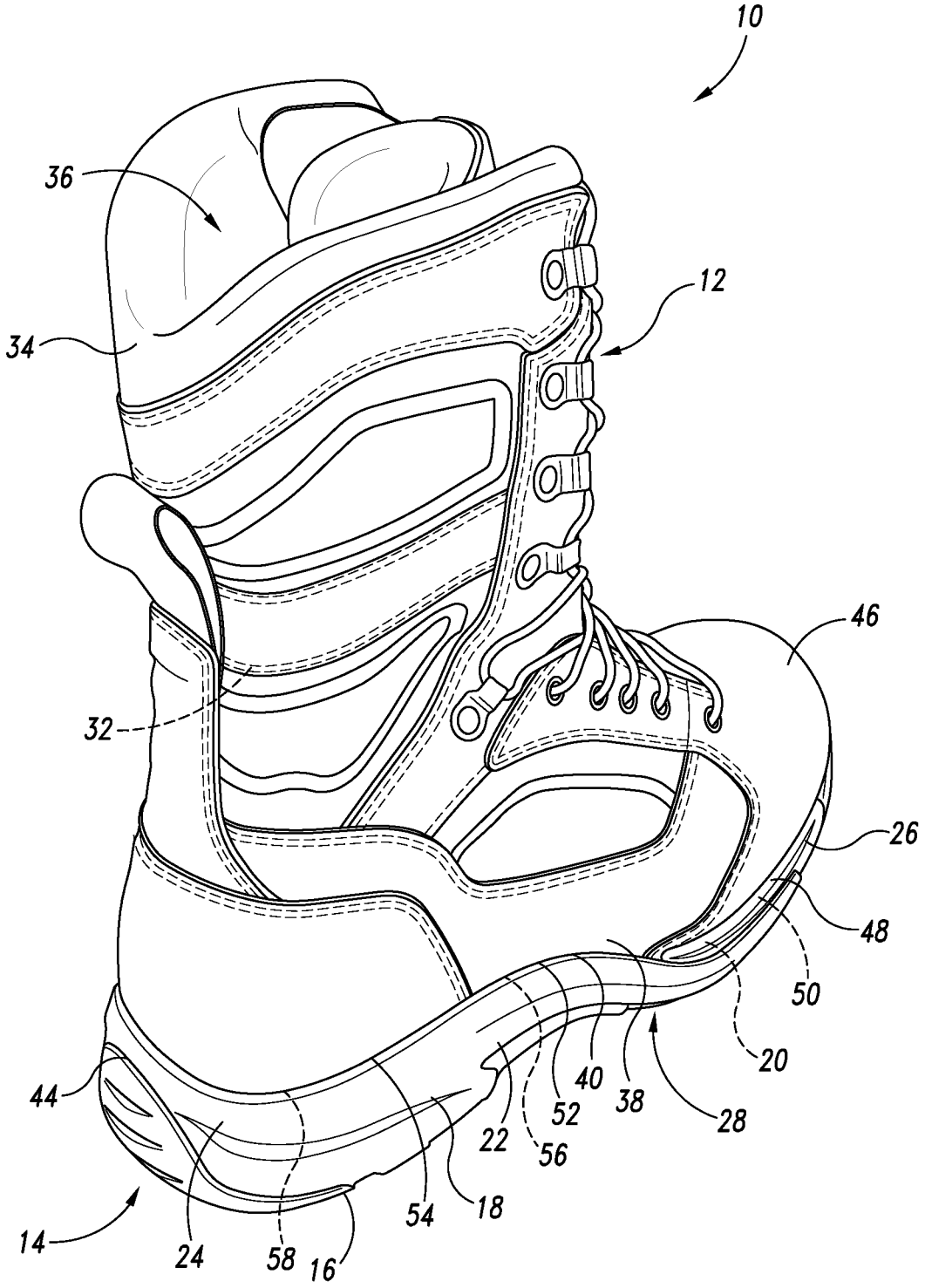
FIG. 1 is a rear isometric view of a lateral side of a footwear assembly configured in accordance with an embodiment of the disclosure.
Figure 2:
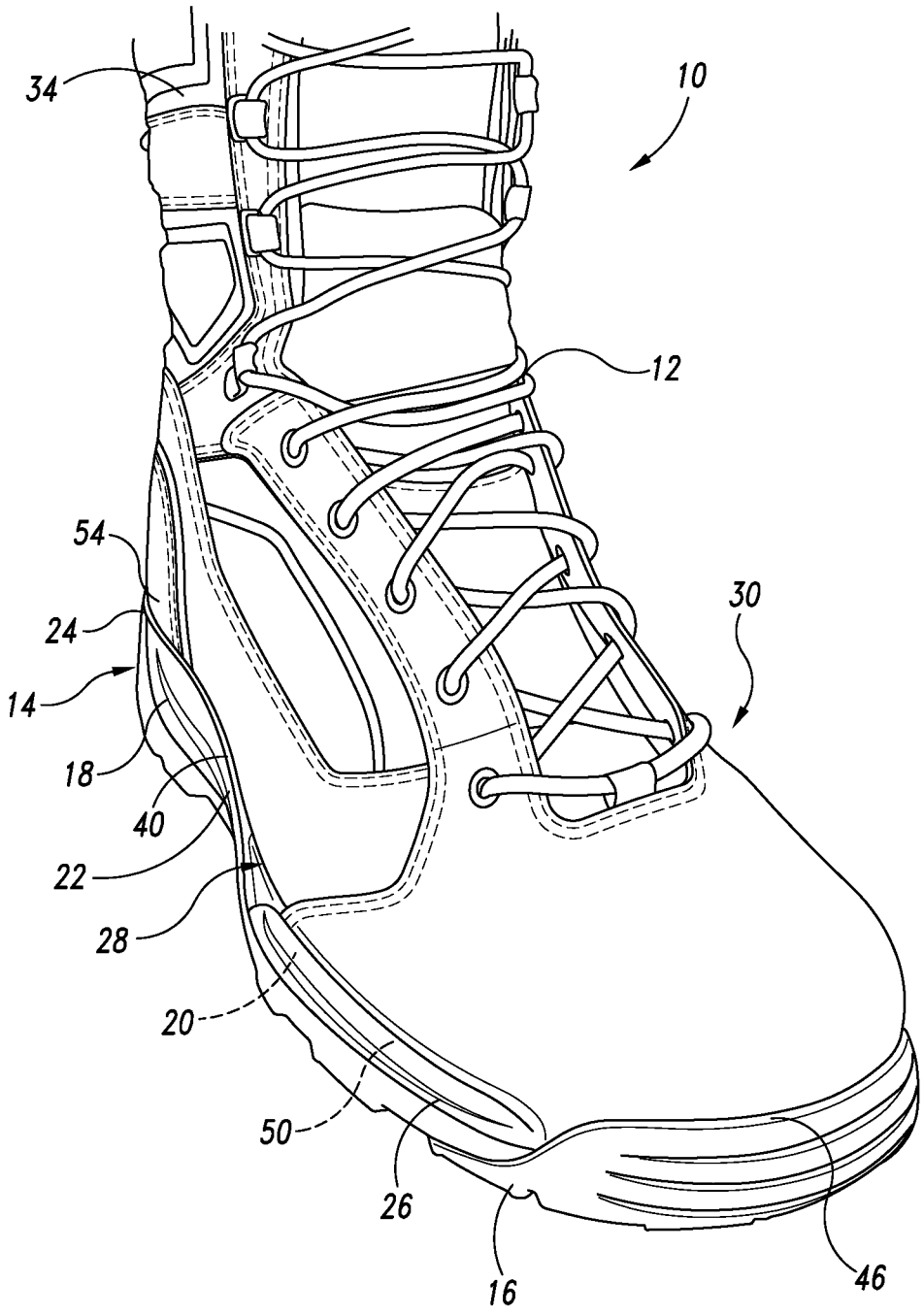
FIG. 2 is a front isometric of a lateral side of the footwear assembly of FIG. 1.
Figure 3:
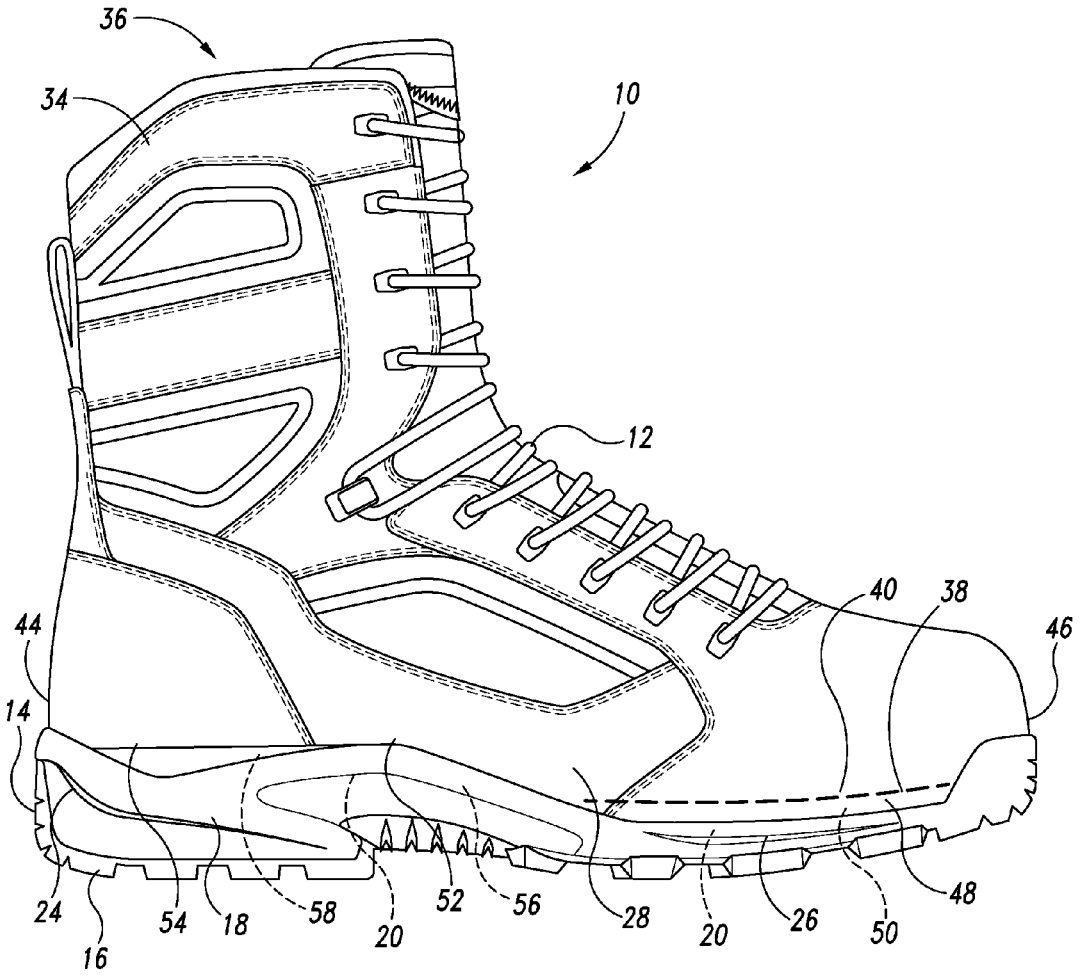
FIG. 3 is a lateral side elevation view of a footwear assembly configured in accordance with an embodiment of the disclosure.
Figure 4:
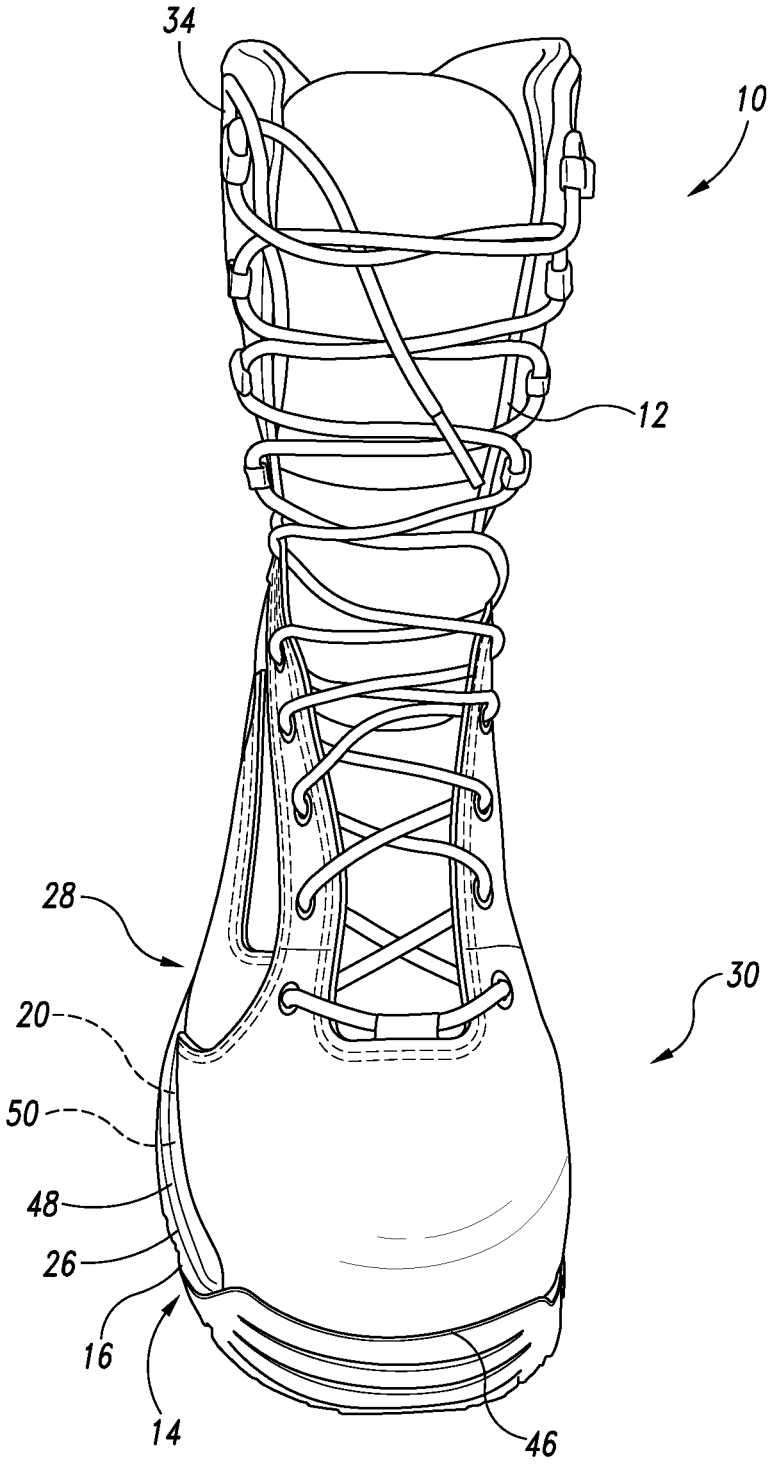
FIG. 4 is a front view of the footwear assembly of FIG. 1.
Figure 5:
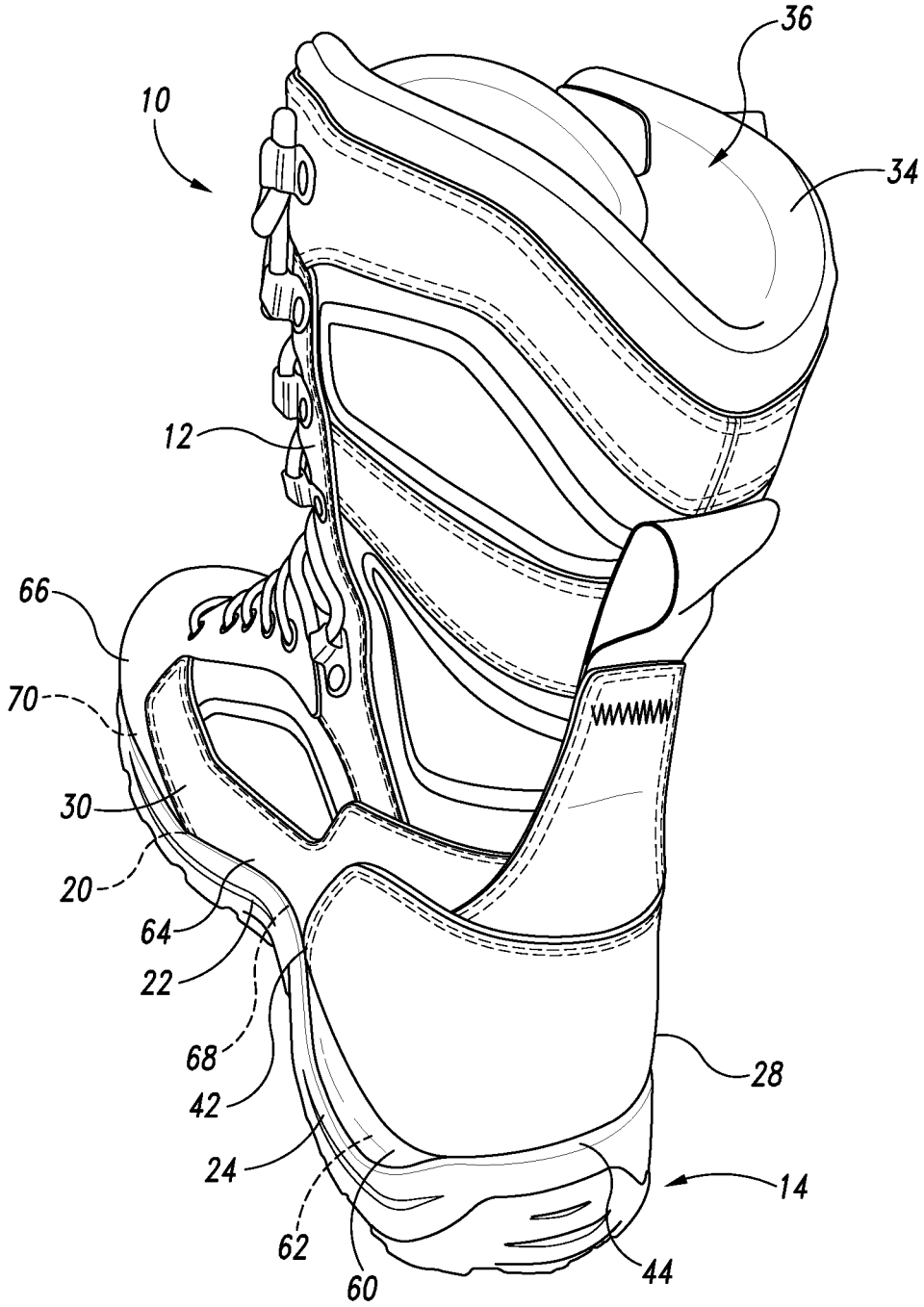
FIG. 5 is a rear isometric view of a medial side of the footwear assembly of FIG. 1.
Figure 6:
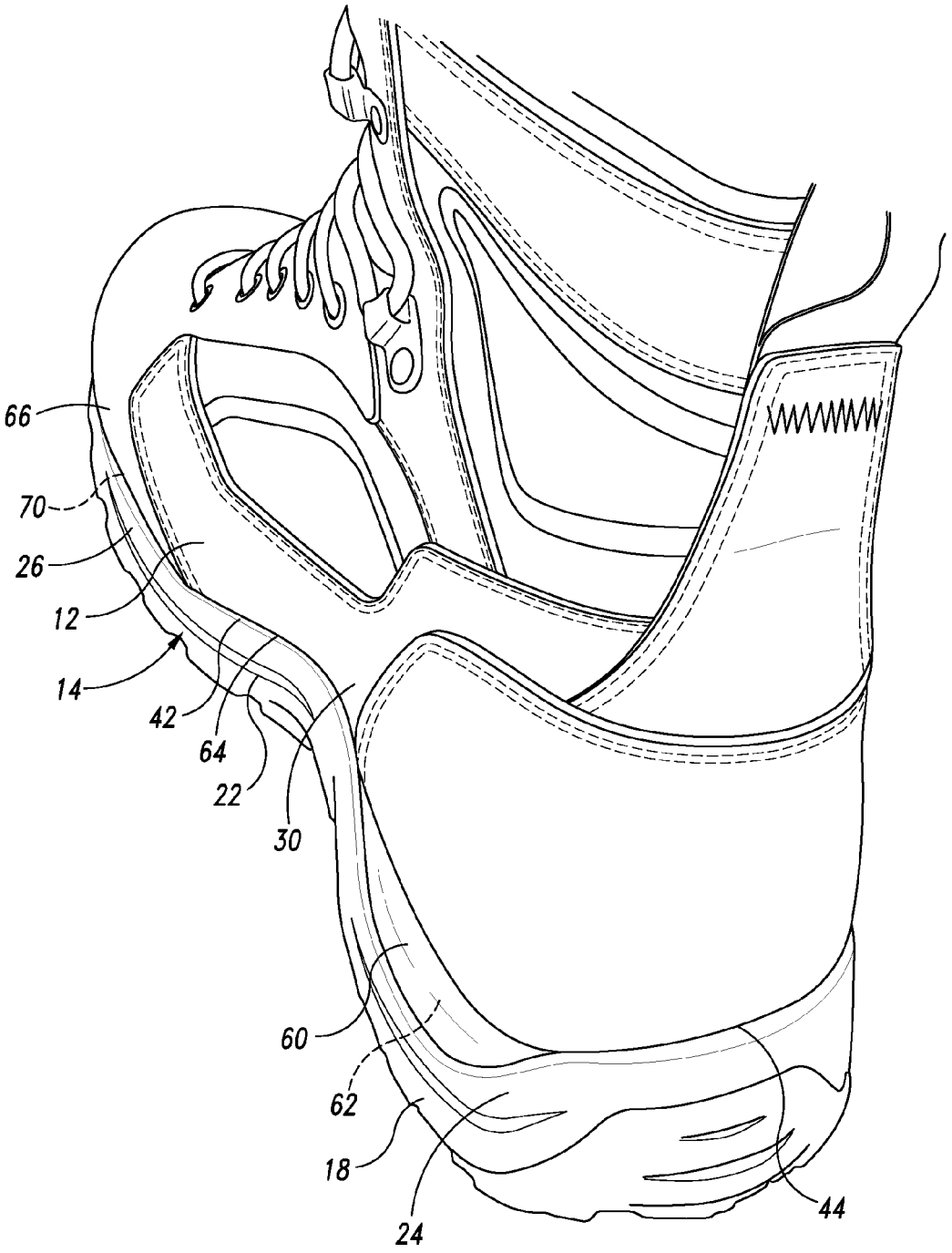
FIG. 6 is an enlarged rear isometric view of the medial side of the footwear assembly of FIG. 5.
Figure 7:
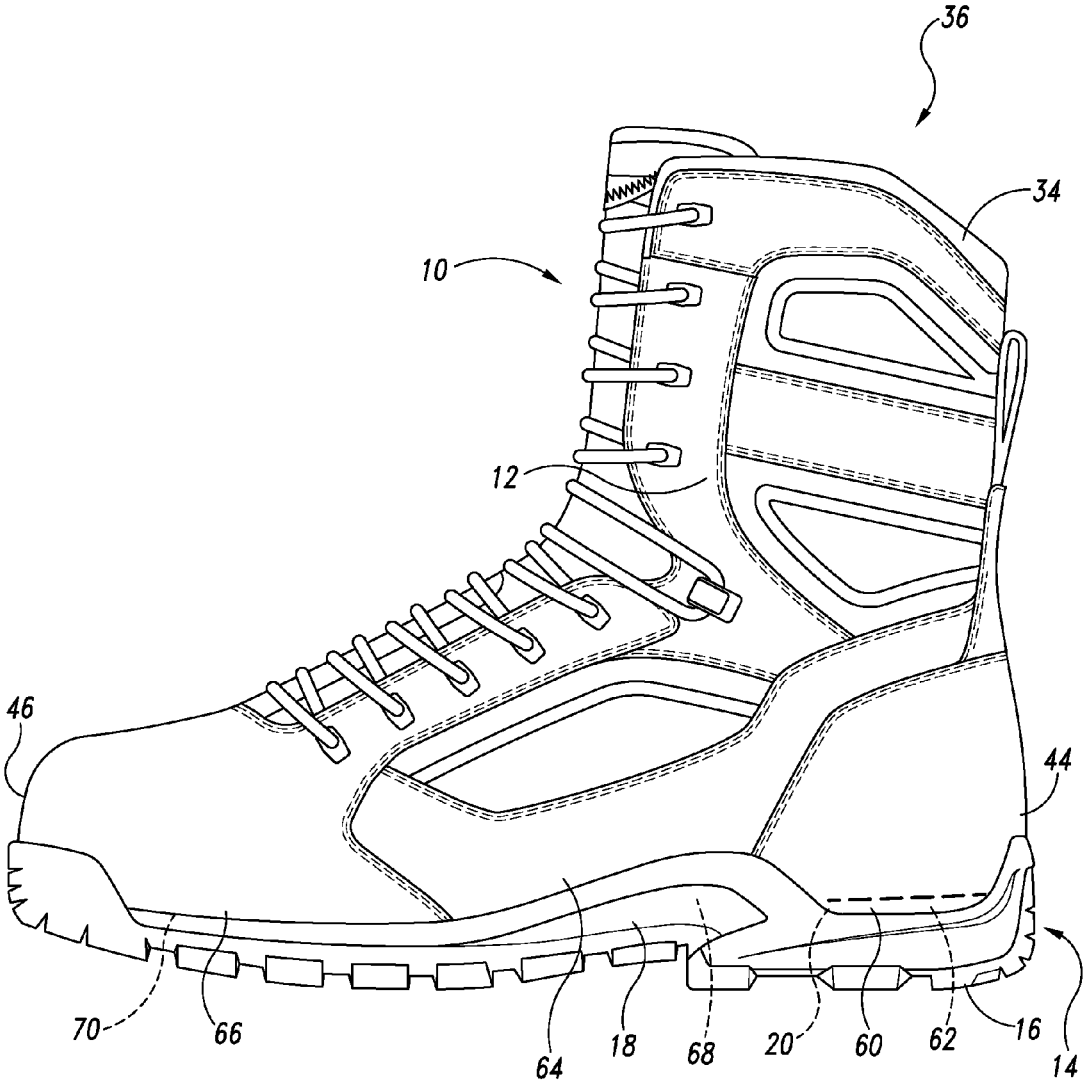
FIG. 7 is a medial side elevation view of a footwear assembly configured in accordance with an embodiment of the disclosure.
Figure 8:
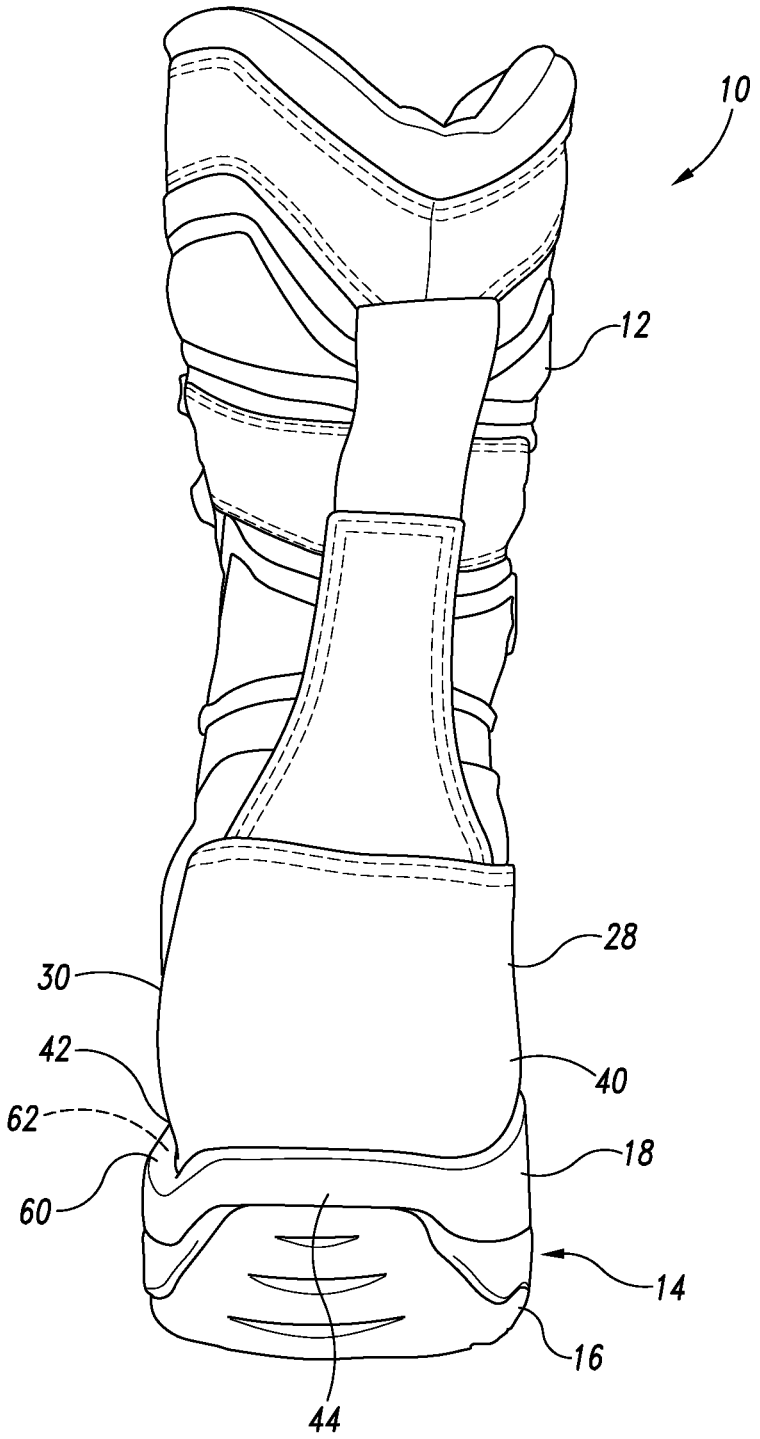
FIG. 8 is a rear view of the footwear assembly of FIG. 6.

FIGS. 1 and 2 are rear and front isometric views of a footwear assembly 10 ("assembly 10") viewed from the lateral side. As will be appreciated by one of ordinary skill in the art, the assembly 10 can include any article of footwear (e.g., a boot, shoe, sandal, etc.) and is not limited to the boot shown in FIG. 1. In the illustrated embodiment, the assembly 10 includes an upper 12 attached to a sole assembly 14. The sole assembly 14 includes an outsole 16 coupled to a midsole 18, as well as an insole board 20 attached to the upper 12 and the midsole 18 as described in detail below. The sole assembly 14 also includes an arch portion 22 positioned between a heel portion 24 and a forefoot portion 26. The sole assembly 14 and the upper 12 also have a lateral side 28 and a medial side 30. As described in detail below, the sole assembly 14 is configured to provide increased support and stability, as well as secure attachment to the upper 12.

The upper 12 of the illustrated embodiment defines an interior area 32 configured to receive the foot of a wearer. The upper 12 has a top portion 34 that defines an opening 36 that provides access to the interior area 32 so the user can move his/her foot into or out of the boot's interior area. The upper 12 also has a lower edge portion 38 that securely connects to the sole assembly 14. The lower edge portion 38 includes a lateral edge portion 40 and medial edge portion 42. The lower edge portion 38 also has a rear edge portion 44 extending between the lateral and medial edge portions 40 and 42 adjacent to the heel portion 24 of the sole assembly 14. The upper's lower edge portion 38 also has a toe edge portion 46 extending between the lateral and medial edge portions 40 and 42 adjacent to the front of the forefoot portion 26 of the sole assembly 14.

The upper 12 of the footwear 10 of the illustrated embodiment is attached to the sole assembly 14 with an asymmetric configuration. As seen in FIGS. 1-4, the forefoot portion 48 of the upper's lateral edge portion 40 flares outwardly over and is stitched to the top of the insole board 20 along its lateral forefoot flange 50. The upper's lateral edge portion 40 in the arch area 52 and the lateral heel area 54 are wrapped around the edge of the insole board 20 and adhered to the bottom surface of the insole board corresponding to the arch area 56 and the lateral heel edge 58. This arrangement along the lateral side of the boot provides a wider, more stable platform at the lateral forefoot portion where the primary loads are located during heel lift and toe off of the gait cycle. The lateral arch area and the lateral heel area, however, have a narrower, tighter conforming profile that provide a designed sharp edge in the outsole generally in closer alignment with the lateral heel and arch portion of the wearer's foot. This configuration can be beneficial when, for example, the wearer is climbing, scrambling, or edging and needs to catch a shallow ledge or the like.

In one embodiment, the upper's lateral heel portion 54 can be wrapped around the insole board 20 and stitched to the bottom surface of the lateral heel edge area 58 of the insole board 20, while the arch area is adhered and remains free of stitching. In another embodiment, the lateral arch area 52 of the upper's lateral edge portion 40 can include stitching to secure the lateral edge portion 40 to the bottom surface of the insole board, although the stitching is discontinuous with the stitching in the lateral forefoot portion and/or the lateral heel portion.

As seen in FIGS. 5-8, the medial side of the footwear assembly 10 has the inverse construction. The medial heel portion 60 of the upper's medial edge portion 42 flares outwardly over and is stitched to the top of the insole board 20 along its medial heel flange 62. The upper's medial edge portion 42 in the medial arch area 63 and the medial forefoot area 66 are wrapped around the edge of the insole board 20 and adhered to the bottom surface of the insole board corresponding to the medial arch area 68 and the medial forefoot area. This arrangement along the medial side of the boot provides a wider, more stable platform at the lateral heel portion where the primary loads are located during heel strike. The medial arch area and the medial forefoot area, however, have a narrower, tighter conforming profile that provide a designed sharp edge in the outsole generally in closer alignment with the wearer's foot, to medial forefoot and arch portion of the wearer's foot.

In one embodiment, the upper's medial forefoot portion 54 can be wrapped around the insole board 20 and stitched to the bottom surface of the medial forefoot edge area 70 of the insole board 20, while the arch area is adhered and remains free of stitching. In another embodiment, the medial arch area 64 of the upper's medial edge portion 42 can include stitching to secure the medial edge portion 42 to the bottom surface of the insole board, although the stitching is discontinuous with the stitching in the medial forefoot portion and/or the medial heel portion.

In the illustrated embodiment, the upper's medial heel portion 60 and lateral forefoot portion 48 are stitched directly to the insole board 20. In other embodiments, these portions of the upper 12 can also be stitched to the midsole 18 and/or to the outsole 16. The upper's lower edge portion 38 can also be stitched to the insole board 20 and/or the midsole 16 in the rear edge portion 44 and/or in the toe edge portion 46. The stitching in the medial heel portion 60 can be continuous or discontinuous with stitching through the rear edge portion 44, and the stitching in the lateral forefoot portion 48 an be continuous or discontinuous with stitching in the toe edge portion 46. In the illustrated embodiment, the toe edge portion 46 is covered by a toe cap portion of the outsole 16. In yet other embodiments, the outsole 16 can include a heel bumper that covers at least a portion of the upper's rear edge portion 44.

Figure 9A:
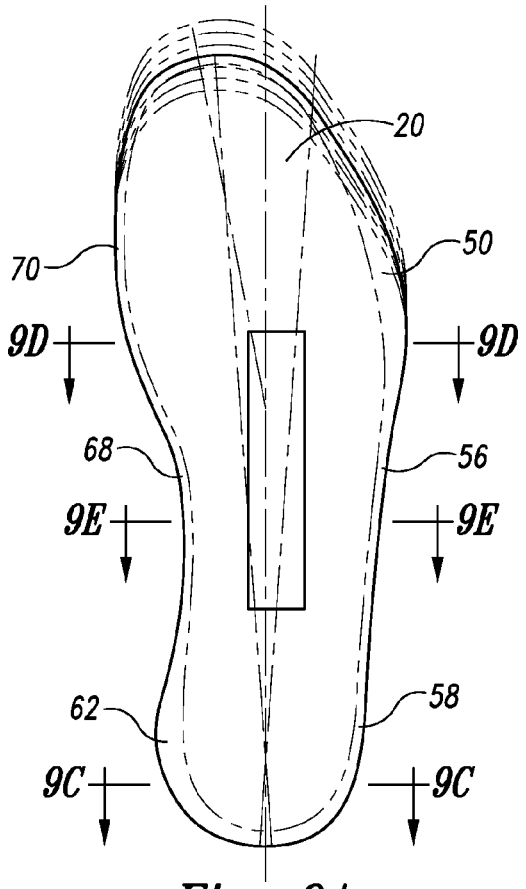
FIG. 9A is a plan view of an insole board of a footwear assembly configured in accordance with an embodiment to the disclosure.
Figure 9B:
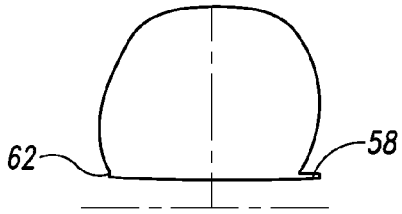
FIGS. 9B-9E are rear and cross-sectional views of the insole board taken substantially along lines C-C, D-D, and E-E of FIG. 9A.
Figure 9C:
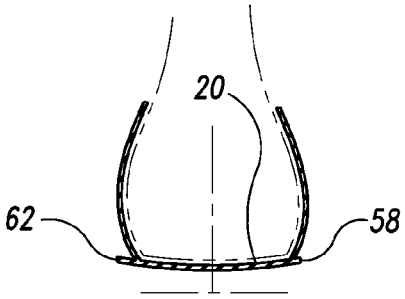
Figure 9D:
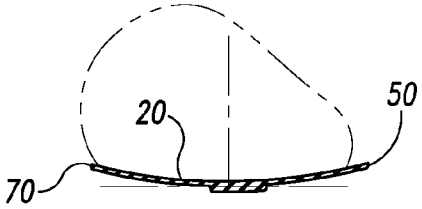
Figure 9E:
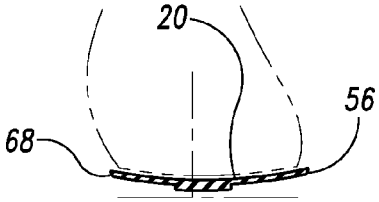

FIG. 9A is a plan view of an insole board 20 of a footwear assembly configured in accordance with an embodiment to the disclosure. FIGS. 9B-9E are rear and cross-sectional views of the insole board 20 taken substantially along lines C-C, D-D, and E-E of FIG. 9A. In the illustrated embodiment, the insole board's medial heel flange 62 is shown in FIGS. 9A, 9B, and 9C. The insole board's lateral forefoot flange 50 is shown in FIGS. 9A and 9D, and the arch area of the insole board is shown in FIGS. 9A and 9E.

The above-described is asymmetric medial-lateral stitching arrangement provides a very stable outsole assembly platform, particularly throughout the wearer's gait cycle during use, while also achieving the benefits of a narrower, tighter profile in the lateral heel area and in the medial forefoot area 66. This narrower, tighter profile in the lateral heel and medial forefoot areas provides an enhanced configuration for the wearer when scaling, climbing, and edging against a structure that my have limited material upon with the boot can engage and grip the structure's surface. The narrower platform also allows the wearer to position the forefoot or heel portions of the footwear in smaller spaces, which can be beneficial when climbing, scaling, and/or edging.

Figure 10:
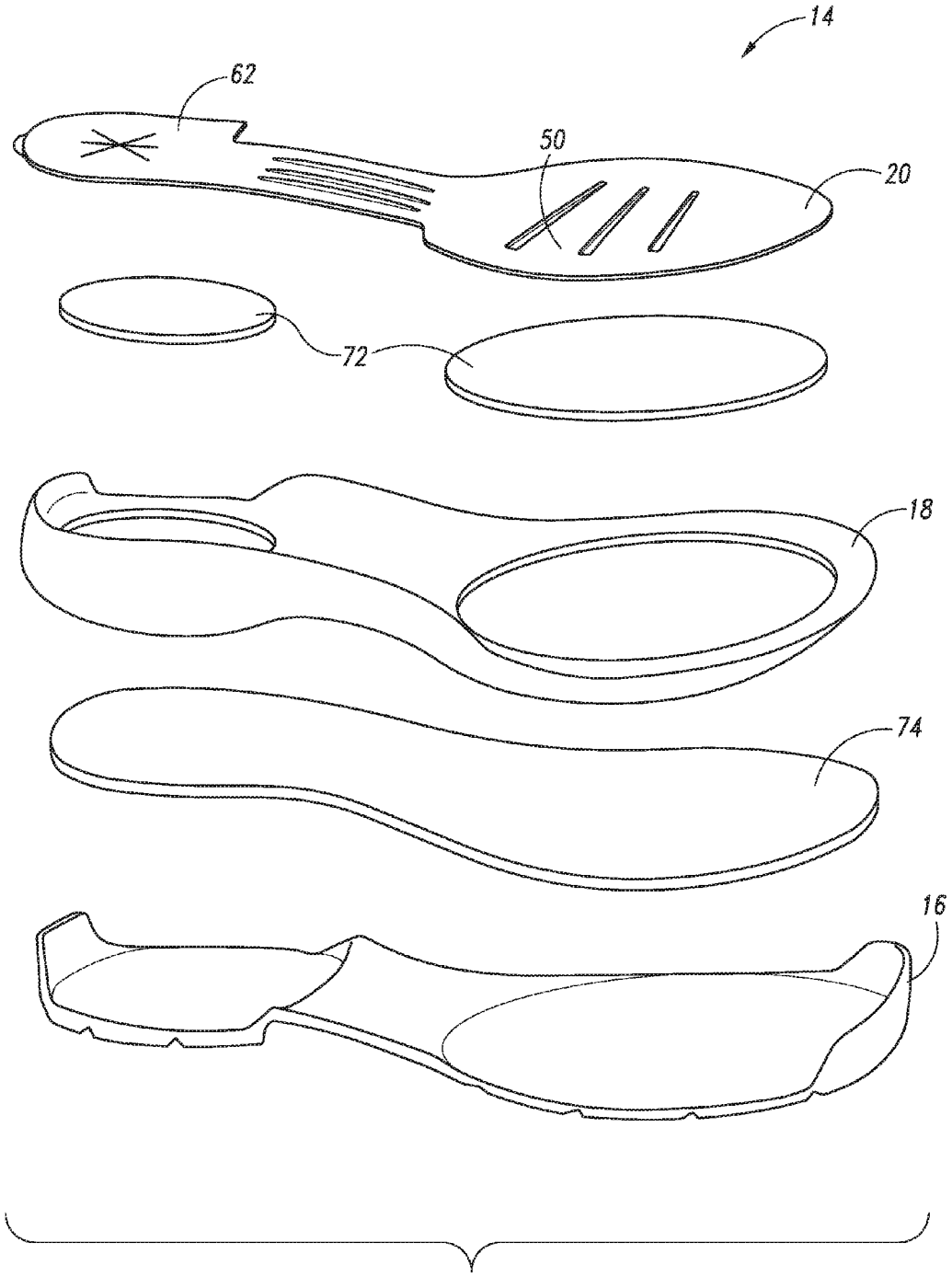
FIG. 10 is a schematic exploded isometric view of a sole assembly of a footwear assembly configured in accordance with an embodiment of the disclosure.

FIG. 10 is an exploded isometric view of the sole assembly 14 of an embodiment. The sole assembly of the illustrated embodiment includes the insole board 20 above a polyurethane midsole 18 that includes EVA inserts or drop-ins 72 in the heel and forefoot areas. The EVA drop-ins can provide increased cushioning and shock absorption, thereby increasing comfort for the wearer. The sole assembly 14 can also include a puncture-resistant plate 74 between the midsole 18 and the outsole. The sole assembly 14 of other embodiments do not include the puncture-resistant plate.

From the foregoing, it will be appreciated that specific embodiments of the disclosure have been described herein for purposes of illustration, but that various modifications may be made without deviating from the spirit and scope of the disclosure. For example, although many of the Figures described above illustrate the midsoles and insoles as having multiple separate components, in other footwear assemblies the midsoles and insoles can include more or less components, including, for instance, integral or one-piece configurations. Further, while various advantages associated with certain embodiments of the disclosure have been described above in the context of those embodiments, other embodiments may also exhibit such advantages, and not all embodiments need necessarily exhibit such advantages to fall within the scope of the disclosure.

We claim:

1. A footwear assembly, comprising:

a sole assembly having an outsole, a midsole connected to the outsole, and an insole board attached to the midsole, the insole board having a heel portion, a forefoot portion, and an arch portion between the heel and forefoot portions, the insole board having lateral and medial sides, a top surface facing away from the midsole, and a bottom surface facing toward the midsole; and an upper having a lower side portion connected to the sole assembly, the lower side portion having a lateral side portion, a medial side portion, a rear side portion extending between the lateral and medial side portions adjacent to the heel portion of the insole board, and a toe side portion extending between the lateral and medial side portions adjacent to the forefoot portion of the insole board, the lateral side portion having a lateral forefoot flange, a lateral arch flange, and a lateral heel flange, and the medial side portion having a medial forefoot flange, a medial arch flange, and a medial heel flange;

wherein the lateral forefoot flange extends fully between the toe side portion and the lateral arch portion, the lateral forefoot flange flares outwardly and is stitched along its length to the top surface of the insole board along the forefoot portion, and the lateral arch flange and the lateral heel flange are wrapped around a first outer most edge of the lateral side of the insole board and are attached to the bottom surface at the arch portion and heel portion without being directly secured to the top surface of the insole board; and wherein the medial heel flange flares outwardly and is stitched along its length to the top surface of the insole board along the heel portion, and the medial arch flange and the medial forefoot flange are wrapped around a second outermost edge of the medial side of the insole board and are attached to the bottom surface at the arch portion and forefoot portion without being directly secured to the top surface of the insole board to define asymmetrically-positioned stitching adjacent to the top surface of only diagonally opposed portions of the insole board.

2. The footwear assembly of claim 1 wherein the lateral forefoot flange is out of engagement with the bottom surface of the insole board.

3. The footwear assembly of claim 1 wherein the medial heel flange is out of engagement with the bottom surface of the insole board.

4. The footwear assembly of claim 1 wherein at least one of the lateral arch flange and the lateral heel flange wrap around the lateral side of the insole board and is stitched to the bottom surface at the arch portion and heel portion.

5. The footwear assembly of claim 1 wherein the lateral arch flange and the lateral heel flange wrap around the lateral side of the insole board and are stitched to the bottom surface at the arch portion and heel portion.

6. The footwear assembly of claim 1 wherein the lateral arch flange and the lateral heel flange are free of stitching to the insole board.

7. The footwear assembly of claim 1 wherein the lateral forefoot flange is stitched with first stitching to the top surface of the insole board, and at least one of the lateral arch flange and the lateral heel flange wraps around the lateral side of the insole board and is stitched with second stitching to the bottom surface at the arch portion or the heel portion, and wherein the first stitching is discontinuous with the second stitching.

8. The footwear assembly of claim 1 wherein the lateral arch flange and the lateral heel flange wrap around the lateral side of the insole board and are adhered and stitched to the bottom surface at the arch portion and heel portion.

9. The footwear assembly of claim 1 wherein at least one of the medial arch flange and the medial forefoot flange wrap around the medial side of the insole board and is stitched to the bottom surface at the arch portion or the forefoot portion.

10. The footwear assembly of claim 1 wherein the medial arch flange and the medial forefoot flange wrap around the medial side of the insole board and are adhered to the bottom surface at the arch portion and forefoot portion.

11. The footwear assembly of claim 1 wherein the medial arch flange and the medial forefoot flange are free of stitching to the insole board.

12. The footwear assembly of claim 1 wherein the medial arch flange and the medial forefoot flange wrap around the lateral side of the insole board and are adhered and stitched to the bottom surface at the arch portion and forefoot portion.

13. The footwear assembly of claim 1 wherein the medial heel flange is stitched with first stitching to the top surface of the insole board, and at least one of the medial arch flange and the medial forefoot flange wraps around the medial side of the insole board and is stitched with second stitching to the bottom surface at the arch portion or the forefoot portion, and wherein the first stitching is discontinuous with the second stitching.

14. The footwear assembly of claim 1 wherein the medial heel flange and the lateral forefoot flange are stitched to the midsole or the outsole.

15. The footwear assembly of claim 1 wherein the rear side portion of the upper's lower side portion is stitched to at least a portion of the heel portion of the insole board.

16. The footwear assembly of claim 1 wherein the toe side portion of the upper's lower side portion is stitched to at least a portion of the forefoot portion of the insole board.

17. A footwear assembly, comprising:

a sole assembly having an insole board having an outermost peripheral edge, a heel portion, a forefoot portion, and an arch portion, a lateral side, a medial side, a top surface, and a bottom surface facing away from the top surface; and an upper having an upper side portion above a lower side portion, the lower side portion having a lateral forefoot flange, a lateral arch flange, a lateral heel flange, a medial forefoot flange, a medial arch flange, and a medial heel flange;

wherein the peripheral edge of the insole board at the forefoot portion projects laterally away from the upper side portion, and the peripheral edge of the insole board at the heel portion is substantially vertically aligned with the upper side portion, wherein the lateral forefoot flange is stitched to the top surface of the insole board along the forefoot portion to define a first side profile relative to the upper side portion, and the lateral arch flange and the lateral heel flange wrap around the peripheral edge along the insole board's lateral side and are attached to the bottom surface at the arch portion and heel portion without being stitched to the insole board's top surface to define a second side profile relative to the upper side portion narrower than the first side profile; and wherein the medial heel flange is stitched to the top surface of the insole board along the heel portion, and the medial arch flange and the medial forefoot flange are wrapped around the peripheral edge along the insole board's medial side and are attached to the bottom surface at the arch portion and forefoot portion without being stitched to the insole board's top surface to define asymmetrically-positioned stitching adjacent to the top surface of only diagonally opposed portions of the insole board.

18. The footwear assembly of claim 17 wherein the lateral arch flange and the lateral heel flange are out of direct engagement with the insole board's top surface.

19. The footwear assembly of claim 17 wherein the medial arch flange and the medial forefoot flange are out of direct engagement with the insole board's top surface.

20. The footwear assembly of claim 17 wherein at least one of the lateral forefoot flange and the medial heel flange is out of engagement with the bottom surface of the insole board.

21. The footwear assembly of claim 17 wherein at least one of the lateral arch flange and the lateral heel flange wraps around the peripheral edge at the insole board's lateral side and is stitched to the bottom surface at the arch portion or the heel portion.

22. The footwear assembly of claim 17 wherein the lateral arch flange and the lateral heel flange are free of stitching to the insole board.

23. The footwear assembly of claim 17 wherein the lateral forefoot flange is stitched with first stitching to the top surface of the insole board, and at least one of the lateral arch flange and the lateral heel flange wraps around the lateral side of the insole board and is stitched with second stitching to the bottom surface at the arch portion or the heel portion, and wherein the first stitching is discontinuous with the second stitching.

24. The footwear assembly of claim 17 wherein the medial heel flange is stitched with first stitching to the top surface of the insole board, and at least one of the medial arch flange and the medial forefoot flange wraps around the medial side of the insole board and is stitched with second stitching to the bottom surface at the arch portion or the forefoot portion, and wherein the first stitching is discontinuous with the second stitching.

25. The footwear assembly of claim 17 wherein a rear side portion of the upper's lower side portion is stitched to at least a portion of the heel portion of the insole board.

26. The footwear assembly of claim 25 wherein the sole assembly has an outsole that has a heel bumper covering at least a portion of the rear side portion stitched to the insole board's heel portion.

27. The footwear assembly of claim 17 wherein a toe side portion of the upper's lower side portion is stitched to at least a portion of the forefoot portion of the insole board.

28. The footwear assembly of claim 27 wherein the sole assembly has an outsole that has a toe bumper covering at least a portion of the toe side portion stitched to the insole board's forefoot portion.

* * * * *